US007677177B2

(12) United States Patent
Ganz

(10) Patent No.: US 7,677,177 B2
(45) Date of Patent: Mar. 16, 2010

(54) DEVICE FOR THE DISASSEMBLY OF RAIL ANCHORS

(75) Inventor: Jörg Ganz, Etoy (CH)

(73) Assignee: MATISA Matériel Industriel SA, Crissier (CH)

( * ) Notice: Subject to any disclaimer, the term of this patent is extended or adjusted under 35 U.S.C. 154(b) by 230 days.

(21) Appl. No.: 11/660,442

(22) PCT Filed: Aug. 11, 2005

(86) PCT No.: PCT/IB2005/002632

§ 371 (c)(1),
(2), (4) Date: Feb. 15, 2007

(87) PCT Pub. No.: WO2006/021879

PCT Pub. Date: Mar. 2, 2006

(65) Prior Publication Data

US 2008/0035009 A1 Feb. 14, 2008

(30) Foreign Application Priority Data

Aug. 27, 2004 (CH) ..... 1411/04

(51) Int. Cl.
*E01B 29/24* (2006.01)
*E01B 29/26* (2006.01)
*E01B 29/05* (2006.01)

(52) U.S. Cl. ..... 104/17.2; 104/17.1; 104/2

(58) Field of Classification Search ..... 104/2, 104/17.1, 17.2
See application file for complete search history.

(56) References Cited

U.S. PATENT DOCUMENTS

| | | | | | |
|---|---|---|---|---|---|
| 3,766,860 | A * | 10/1973 | McIlrath | 104/17.2 |
| 4,580,501 | A * | 4/1986 | Collins et al. | 104/307 |
| 4,895,078 | A * | 1/1990 | Mancini | 104/8 |
| 5,074,219 | A * | 12/1991 | Theurer et al. | 104/17.2 |
| 5,117,760 | A * | 6/1992 | Almaraz et al. | 104/2 |
| 5,438,931 | A * | 8/1995 | Becker et al. | 104/17.2 |
| 5,546,864 | A * | 8/1996 | Straub et al. | 104/17.2 |
| 5,586,502 | A * | 12/1996 | Weber | 104/17.2 |
| 5,694,856 | A * | 12/1997 | Theurer | 104/17.2 |
| 5,730,060 | A * | 3/1998 | Straub et al. | 104/17.2 |
| 5,915,744 | A * | 6/1999 | Cotsford | 29/426.3 |
| 6,662,729 | B1 * | 12/2003 | Madison | 104/17.2 |
| 2008/0035009 | A1 * | 2/2008 | Ganz | 104/2 |

FOREIGN PATENT DOCUMENTS

| | | |
|---|---|---|
| EP | 0 285 847 A | 10/1988 |
| EP | 0 285 847 B | 7/1991 |
| EP | 1 424 444 A | 6/2004 |
| WO | WO 00/36219 A | 6/2000 |

* cited by examiner

*Primary Examiner*—S. Joseph Morano
*Assistant Examiner*—Jason C Smith
(74) *Attorney, Agent, or Firm*—Frommer Lawrence & Haug LLP; Ronald R. Santucci

(57) ABSTRACT

The invention relates to a device for the disassembly of a rail anchor, connecting a rail to a sleeper of a track, comprising two opposing tool levers, connected by a rod, operated with displacement about a pivot axis by means of a press drive. A first tool lever is connected to the press drive, coupled to the tool frame. A further tool lever is defined at an upper end by the pivot axis.

11 Claims, 1 Drawing Sheet

DEVICE FOR THE DISASSEMBLY OF RAIL ANCHORS

Figures 1, 2, 3, 4:
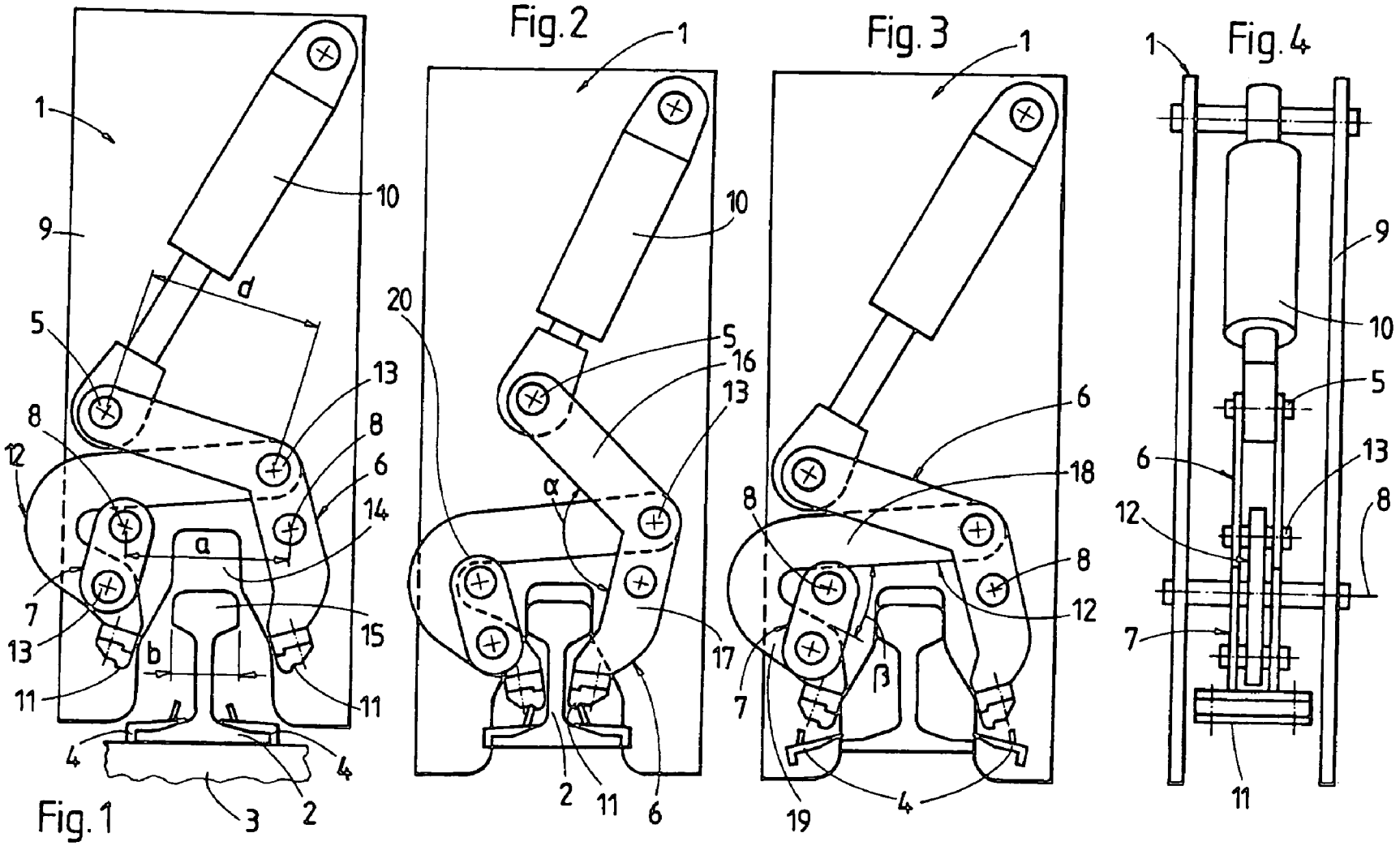

This application is a 371 of PCT/IB2005/002632 filed on Aug. 11, 2005, published on Mar. 2, 2006 under publication number WO 2006/021879 A1 which claims priority benefits from Swiss Patent Application Number 01411/04 filed Aug. 27, 2004.

The invention relates to an apparatus for installing and removing rail anchors connecting a rail to a sleeper of a track, comprising two mutually opposite tool levers which can be moved about a pivot axis by an auxiliary drive in a direction transverse to the longitudinal direction of the rail, are connected to one another by a parallel link, are mounted on a tool frame and on the underside of which is arranged a respective contact part which is provided for abutment against a rail anchor.

Such an apparatus is known from WO 00/36219.

The object of the present invention, then, is to provide an apparatus of the generic type which, with low design outlay, allows the reliable removal and installation of rail anchors.

This object is achieved according to the invention by an apparatus of the type mentioned in the introduction having the features cited in the characterizing part of claim 1.

Further advantages and embodiments of the invention can be gathered from the rest of the claims and the drawing.

The invention is described in more detail hereinbelow with reference to an exemplary embodiment illustrated in the drawing, in which:

FIGS. 1, 2 and 3 each show a view of the apparatus in the longitudinal direction of the rail, and FIG. 4 shows a view in a direction normal to the longitudinal direction of the rail.

An apparatus 1 can be used for removing rail anchors 4 connecting a rail 2 to a sleeper 3 of a track. A first tool lever 6 and a second tool lever 7 are mounted on a tool frame 9 in each case via a pivot axis 8 running parallel to the longitudinal direction of the rail. The first tool lever 6 is connected, with an articulation 5 being formed in the process, to an auxiliary drive 10, which is fastened on the tool frame 9, and, at a lower end, to a contact part 11, which is provided for abutment against the rail anchor 4. The two tool levers 6, 7 are connected to one another by a parallel link 12, with articulations 13 being formed in the process, this parallel link having, at a lower end, a contact part 11 which is provided for abutment against the rail anchor 4. The second tool lever 7 is bounded at an upper end by the pivot axis 8.

As an alternative, the contact part 11 could also be connected to a lower end of the second tool lever 7 rather than to the parallel link 12.

At its lower end, the tool frame 9 has a centering recess 14 for accommodating a rail head 15 or foot. The two pivot axes 8 are spaced apart from one another by a distance a—which corresponds approximately to two to approximately three times the rail-head width b of the rail 2. An upper lever portion 16 of the first tool lever 6, this upper lever portion being bounded by the articulation 5, 13 of the auxiliary drive 10 and of the parallel link 12, encloses an angle $\alpha$ of approximately 110° to 130° with a lower lever portion 17, which is bounded by the articulation 13 of the parallel link 12 and the contact part 11. The two lever portions 16, 17 are designed to be of approximately equal length.

A distance d between the articulation 13 of the parallel link 12 and the articulation 5 of the auxiliary drive 10 corresponds approximately to the distance a between the two pivot axes 8. The parallel link 12 is made up of an upper link portion 18, which is positioned above the two pivot axes 8 and is articulated on the first tool lever 6, and a lower link portion 19, which encloses an acute angle $\beta$ with the upper link portion and is articulated on the second tool lever 7.

The invention claimed is:

1. An apparatus for installing and removing rail anchors connecting a rail to a sleeper of the track, comprising two mutually opposite tool levers which can be moved about a pivot axis by an auxiliary drive in a direction transverse to the longitudinal direction of the rail, are connected to one another by a parallel link, are mounted on a tool frame and on the underside of which is arranged a respective contact part which is provided for abutment against a rail anchor, wherein a first tool lever is connected to the auxiliary drive, which is articulated on the tool frame, and a second tool lever is bounded at an upper end by the pivot axis.

2. The apparatus as claimed in claim 1, wherein the two pivot axes are spaced apart from one another by a distance a—which corresponds approximately to two to approximately three times the rail-head width b of the rail.

3. The apparatus as claimed in claim 2, wherein an upper lever portion of the first tool lever, this upper lever portion being bounded by an articulation of the auxiliary drive and of the parallel link, encloses an angle $\alpha$ of approximately 110° to 130° with a lower lever portion, which is bounded by the articulation of the parallel link and contact part.

4. The apparatus as claimed in claim 2, wherein the parallel link is formed from an upper link portion, which is positioned above the two pivot axes and is articulated on the tool lever, and a lower link portion, which encloses an acute angle $\beta$ with the upper link portion and is articulated on the second tool lever.

5. The apparatus as claimed in claim 1, wherein an upper lever portion of the first tool lever, this upper lever portion being bounded by an articulation of the auxiliary drive and of the parallel link, encloses an angle $\alpha$ of approximately 110° to 130° with a lower lever portion, which is bounded by the articulation of the parallel link and contact part.

6. The apparatus as claimed in claim 5, wherein the upper and lower lever portions are designed to be of approximately equal length in each case.

7. The apparatus as claimed in claim 6, wherein the parallel link is formed from an upper link portion, which is positioned above the two pivot axes and is articulated on the tool lever, and a lower link portion, which encloses an acute angle $\beta$ with the upper link portion and is articulated on the second tool lever.

8. The apparatus as claimed in claim 5, wherein a distance d between the articulation of the parallel link and articulation of the auxiliary drive is made to correspond approximately to the distance a between the two pivot axes.

9. The apparatus as claimed in claim 8, wherein the parallel link is formed from an upper link portion, which is positioned above the two pivot axes and is articulated on the tool lever, and a lower link portion, which encloses an acute angle $\beta$ with the upper link portion and is articulated on the second tool lever.

10. The apparatus as claimed in claim 5, wherein the parallel link is formed from an upper link portion, which is positioned above the two pivot axes and is articulated on the tool lever, and a lower link portion, which encloses an acute angle $\beta$ with the upper link portion and is articulated on the second tool lever.

11. The apparatus as claimed in claim 1, wherein the parallel link is formed from an upper link portion, which is positioned above the two pivot axes and is articulated on the tool lever, and a lower link portion, which encloses an acute angle $\beta$ with the upper link portion and is articulated on the second tool lever.

* * * * *